US008734715B2

(12) United States Patent
Miller

(10) Patent No.: US 8,734,715 B2
(45) Date of Patent: May 27, 2014

(54) METHOD FOR THE PREPARATION OF FERROUS LOW CARBON POROUS MATERIAL

(75) Inventor: Curtis Jack Miller, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 243 days.

(21) Appl. No.: 13/006,141

(22) Filed: Jan. 13, 2011

(65) Prior Publication Data

US 2012/0183428 A1 Jul. 19, 2012

(51) Int. Cl.
*B22F 3/11* (2006.01)
*B22F 3/12* (2006.01)

(52) U.S. Cl.
USPC ..... 419/2; 419/36; 419/37; 419/40; 419/41; 419/42

(58) Field of Classification Search
USPC ..... 75/252; 419/2, 26, 37, 40, 41, 42
See application file for complete search history.

(56) References Cited

U.S. PATENT DOCUMENTS

| | | | | |
|---|---|---|---|---|
| 3,672,882 | A | 6/1972 | Sagmuller et al. | |
| 3,677,749 | A | 7/1972 | McCurdy et al. | |
| 4,871,497 | A | 10/1989 | Natori et al. | |
| 4,882,110 | A * | 11/1989 | Kramer et al. | 264/670 |
| 5,063,003 | A | 11/1991 | Gonzales-Oliver | |
| 5,089,070 | A * | 2/1992 | McAndrew | 156/89.14 |
| 5,091,346 | A * | 2/1992 | Inoue et al. | 501/93 |
| 5,366,679 | A * | 11/1994 | Streicher | 419/36 |
| 5,378,567 | A | 1/1995 | Nozomi et al. | |
| 5,864,071 | A | 1/1999 | Kosco | |
| 6,224,990 | B1 | 5/2001 | Hahn et al. | |
| 6,248,286 | B1 | 6/2001 | Lauf et al. | |
| 6,319,459 | B1 | 11/2001 | Melody et al. | |
| 6,365,082 | B1 | 4/2002 | Walls et al. | |
| 6,375,710 | B2 | 4/2002 | Moore et al. | |
| 6,376,585 | B1 | 4/2002 | Schofalvi et al. | |
| 6,485,676 | B1 * | 11/2002 | Wheeler et al. | 419/37 |
| 6,502,623 | B1 | 1/2003 | Schmitt | |
| 6,669,898 | B2 * | 12/2003 | Gressel et al. | 419/36 |
| 7,074,254 | B2 | 7/2006 | Fujisawa et al. | |
| 7,288,222 | B2 | 10/2007 | Matsumoto et al. | |
| 8,007,370 | B2 * | 8/2011 | Hirsch et al. | 473/340 |
| 2003/0063993 | A1 * | 4/2003 | Reiter et al. | 419/36 |
| 2005/0196312 | A1 | 9/2005 | Nyberg et al. | |
| 2005/0233230 | A1 | 10/2005 | Carmichael et al. | |
| 2007/0068340 | A1 | 3/2007 | Nyberg et al. | |
| 2008/0175885 | A1 * | 7/2008 | Asgari | 424/426 |
| 2008/0226489 | A1 * | 9/2008 | Sakata et al. | 419/38 |
| 2011/0256016 | A1 * | 10/2011 | Zeng et al. | 419/38 |

FOREIGN PATENT DOCUMENTS

| | | | |
|---|---|---|---|
| EP | 0 500 129 | B1 | 8/1992 |

OTHER PUBLICATIONS

S.V. Kailas, "Chapter 10. Applications and Processing of Ceramics," Material Science, Indian Institute of Science, Bangalore, India (7 pages).

G.M. Buck et al.,"Rapid Fabrication of Flat Plate Cavity Phosphor Thermography Test Models for Shuttle Return-to-Flight Aero-Heating," Hampton, Virginia, NASA/TM-2006-214508.

* cited by examiner

*Primary Examiner* — Jessee Roe
*Assistant Examiner* — Ngoclan T Mai
(74) *Attorney, Agent, or Firm* — Pauley Petersen & Erickson

(57) ABSTRACT

A method for preparing a porous metal article using a powder metallurgy forming process is provided which eliminates the conventional steps associated with removing residual carbon. The method uses a feedstock that includes a ferrous metal powder and a polycarbonate binder. The polycarbonate binder can be removed by thermal decomposition after the metal article is formed without leaving a carbon residue.

21 Claims, 1 Drawing Sheet

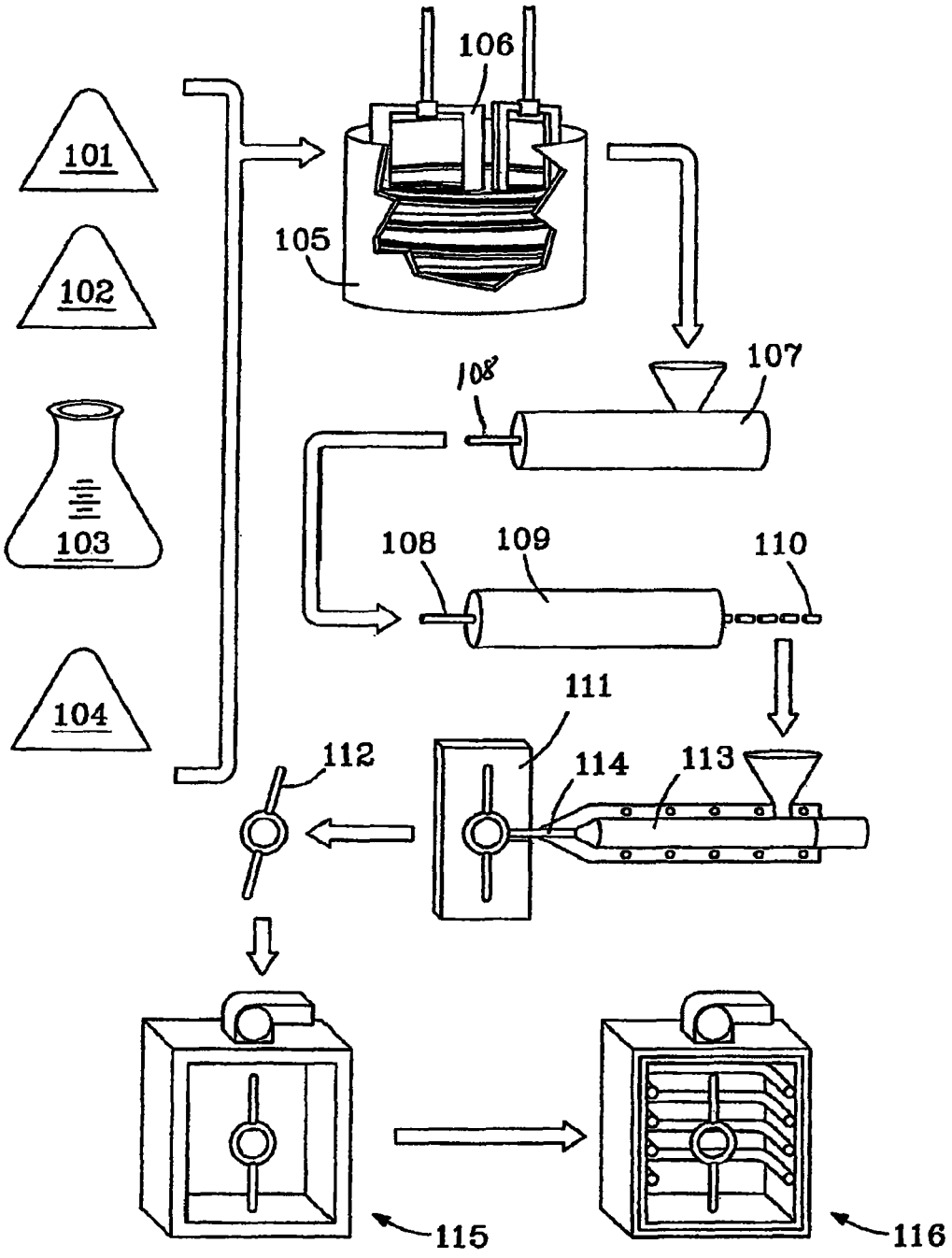
101
102
103
104
105
106
107
108
108
109
110
111
112
113
114
115
116

METHOD FOR THE PREPARATION OF FERROUS LOW CARBON POROUS MATERIAL

GOVERNMENT RIGHTS

This invention was made with government support under Contract No. DE-AC05-00OR22725 awarded by the U.S. Department of Energy. The government has certain rights in the invention.

FIELD OF THE INVENTION

The present invention relates to the preparation of ferrous low carbon porous materials using a polycarbonate binder.

BACKGROUND OF THE INVENTION

Various organic binders or waxes are used in powder metallurgy fabrication operations to form specific shapes from ferrous metal powders. Examples of known organic binders include aromatic binders, dimethyl sulfone binders, organic acid-based binders, and polypropylene carbonate binders, among others. In a typical process, the binder is mixed with the metal powder to form a feedstock. The feedstock is then formed into a metal article using a powder metallurgy forming process. Such forming processes include metal injection molding, extrusion compression molding, tape casting, doctoring, and isostatic pressing, among others.

Temperatures in these powder metallurgy forming processes are high enough to decompose the organic binders, leaving residual carbon. The residual carbon must then be removed at temperatures below about 600° C. If the temperature exceeds 600° C., then the residual carbon becomes chemically attached and incorporated into the ferrous lattice of the metal article. By exposing the metal article to oxygen or air at about 450-530° C., the residual carbon can be converted into carbon dioxide and released from the ferrous lattice.

Exposing the metal article to oxygen or air at these temperatures, to remove residual carbon, causes unwanted oxidation of the ferrous lattice. The metal article must then be processed in a reducing atmosphere. In some instances, the oxidation is very difficult to reduce. In order to simplify the process for preparing metal articles from ferrous metal powders, there is a need or desire to minimize or eliminate the formation of residual carbon.

Carbon may also be removed from carbonized ferrous materials by heating to temperatures near the melting point. In the case of articles that are to remain porous, this results in a non-porous structure that is not fit for its intended use.

SUMMARY OF THE INVENTION

The present invention is directed to a method of preparing a ferrous porous metal article having low carbon content, that does not require treatment in an oxidizing atmosphere at 300-600° C. to remove residual carbon from the metal article, does not cause unwanted oxidation of the metal article, and therefore does not require processing the metal article in a reducing atmosphere to reverse the oxidation.

The method includes the steps of mixing a ferrous metal powder with a polycarbonate binder to form a feedstock, introducing the feedstock to a powder metallurgy process, forming the feedstock into a metal article, and heating the metal article to decompose and remove the polycarbonate binder and sinter or consolidate the ferrous porous metal article. Polycarbonate binder decomposes without leaving a carbon residue regardless of whether the surrounding atmosphere is inert, reducing, or oxidizing. This is because polycarbonates contain chemically bound oxygen and decompose directly to carbon dioxide, without producing elemental carbon. The resulting ferrous metal article suitably has a carbon content no greater then the carbon context of the starting ferrous metal powder, without requiring a step for removing residual carbon.

With the foregoing in mind, it is a feature and advantage of the invention to provide a method of preparing a ferrous porous metal article having a low carbon content, which does not require a step of removing residual carbon or reducing oxides.

BRIEF DESCRIPTION OF THE DRAWINGS

The foregoing and other features and advantages of the invention will be better understood from the following detailed description taken in conjunction with the drawing, wherein:

FIG. 1 is a schematic of one embodiment of the method of preparing a ferrous porous metal article having low carbon content by an injection molding method.

DETAILED DESCRIPTION OF THE INVENTION

The present invention is directed to a method of preparing a ferrous porous metal article having low carbon content. The method does not require the step of removing residual carbon from the metal article using air or oxygen, in order to achieve the low carbon content.

As used herein, the phrase "low carbon content" refers to a carbon content of less than about 0.1% by weight of the ferrous metal powder or ferrous porous metal article, suitably less then about 0.05% by weight, or preferably less than about 0.03% by weight. Suitably, the carbon content of the ferrous porous metal article is about equal to or less than the carbon content of the ferrous metal powder from which it is formed.

The method includes the step of mixing a ferrous metal powder with a polycarbonate binder to form a feedstock. The term "ferrous metal powder" refers to any metal powder that contains at least about 10% by weight iron in a pure or alloyed form. Examples of ferrous metal powder include without limitation iron, iron-chromium alloys such as ferritic stainless steels, iron-chromium-nickel alloys such as austenitic stainless steels, iron-chromium-zinc alloys, iron-chromium-aluminum alloys, iron-chromium-magnesium alloys, iron-chromium-lead alloys, iron-aluminum alloys, iron-zinc alloys, all stainless steels, iron-nickel alloys, and combinations thereof. The ferrous metal powder constitutes about 50-98% by weight of the feedstock, suitably about 80-96% by weight, preferably about 90-95% by weight.

The term "polycarbonate binder" refers to binder polymers that include the following carbonate group as part of a repeating chemical structure:

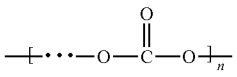

When polycarbonate binders thermally decompose, they release carbon dioxide and, in some instances, volatile organic compounds, but do not leave elemental residual carbon. Polycarbonates can be prepared by reacting an aromatic difunctional phenol with phosgene or an aromatic or aliphatic carbonate. Various polycarbonates can be used as binders, including without limitation bisphenol P-type polycarbonates, bisphenol Z-type polycarbonates, copolymer-type polycarbonates of bisphenol P and bisphenol A, copolymers of a structural unit derived from benzophenone and a structural unit derived from diphenylmethan, poly (propylene carbonate), poly (ethylene carbonate), and combinations thereof. For purposes of the invention, particularly suitable polycarbonate binders include poly (propylene carbonate) and poly (ethylene carbonate). The polycarbonate binder can have a weight average molecular weight of about 100,000 to about 350,000 grams per mole. The polycarbonate binder should constitute about 2-50% by weight of the feedstock, suitably about 4-20% by weight, or preferably about 5-10% by weight.

Referring to FIG. 1, the feedstock can be prepared by mixing a ferrous metal powder from source 101 with a polycarbonate binder from source 102 and a solvent from source 103 using a high shear mixer 105 having impellers 106. Optional polymers, surfactants, sintering acids, lubricants and other additives can be added to the mixture, as needed, from source 104. The combined feedstock ingredients are mixed together in high shear mixer 105 at a suitable temperature for a suitable period of time, as will be apparent to persons of ordinary skill in the art. Suitably, the mixing temperature will be lower than the boiling temperature of the solvent to minimize premature degradation of the binder and premature solidification of the feedstock. The mixing temperature can be about ambient to about 80° C., and the mixing time can be about 30 to about 180 minutes. Other suitably mixing techniques familiar to persons skilled in the art can also be employed.

The feedstock form source 105 can be used for compression forming, extrusion, or isostatic pressing. The solvent in the mixture can be varied to adjust the viscosity for the particular forming operation. The feedstock with remaining solvent will be a pliable dough-like mixture that can be formed into numerous shapes such as rods, tubes, sheets, or irregular shapes.

The step of forming the feedstock can also include the steps of solidifying and pelletizing the feedstock. This is normally done so the feedstock can be used in injection molding, cold pressing, or hot pressing. This can be accomplished by evaporating the solvent from the mixture in mixer 105 to solidify the polycarbonate binder. The decreased temperature causes the binder to solidify and the mixer blades 106 then granulate the feedstock into pellets, granules or powders.

The steps of solidifying and pelletizing the feedstock can alternatively be performed using an extruder mixer 107 and pelletizer 109. The extruder mixer 107 mixes the feedstock ingredients and extrudes one or more thin rods 108 through an extrusion die. The cooled rod 108 is fed to a pelletizer 109 that forms the rod into pellets 110.

The feedstock pellets 110 can be processed using an extrusion injector 113, or another suitable process, and can be fed through a barrel 114 to an injection mold 111. Injection molding is only one example of a process that can be used to form the ferrous metal parts 112. Other processes such as extrusion, compression forming, tape casting, doctoring, and isostatic pressing can also be used to form the ferrous metal parts 112. Any ferrous metal part thus formed is in a green state, meaning the polycarbonate binder has not yet been removed.

The green ferrous metal part 112 is then fed to an oven or furnace 115 which performs a debinding step. The debinding step removes the polycarbonate binder from the metal part 112 and is performed by heating the metal part 112 to a temperature of about 280 to about 360° C. at a rate of about 0.5° C. per minute to about 5° C. per minute. The feed rate to the oven or furnace 115 depends on the size of the heating chamber and should be sufficient to replace the chamber volume every 0.5 to 5 minutes. During the debinding step, the polycarbonate binder decomposes to carbon dioxide and, depending on the particular binder, volatile organic components. No residual carbon is left behind in the metal part 112, which leaves the debinder in a brown state.

The oven or furnace 115 may then have its temperature increased to a final sintering temperature. Alternatively, the ferrous metal part 112 can then be fed to a sintering chamber 116 which performs a sintering step in order to sinter or consolidate the metal part 112 and maintain it as a coherent mass. The sintering can be performed by raising the temperature of the metal part 112 to between about 500 and about 1500° C., and maintaining that temperature for about 0.5 to about 2 hours. The sintering can be performed in stages and the temperature and atmosphere required depend on the material type, particle size and particle morphology of the metallic powder comprising the article. Most stainless steels melt at 1300-1500° C. and sinter at 800-1200° C. The sintering can be performed in an atmosphere of hydrogen, argon, nitrogen, vacuum, or another atmosphere that is free of oxygen and reactive impurities. The optimal sintering conditions will vary depending on the size and shape of the ferrous metal part 112 and its metal composition.

Feedstock formulas can be selected by finding the tap density of the ferrous metal powder and using the tap density to calculate the void volume of the powder. The volume of polycarbonate binder that is mixed with the ferrous metal powder is usually between 10% and 150% of the void volume of the ferrous metal powder, depending on the application.

The ferrous metal powder used in the feedstock can have a carbon content of less than about 0.1% by weight, suitably less than about 0.05% by weight, or preferably less than about 0.03% by weight. The finished ferrous metal part 112 can have a carbon content of less than about 0.1% by weight, suitably less than about 0.05% by weight, preferably less than about 0.03% by weight. Suitably, the carbon content of the finished ferrous metal part 112 is about equal to, or no more than, the carbon content of the ferrous metal powder used in the feedstock.

EXAMPLES

Porous disks were prepared using dry pressing of a feedstock mixture of metal powder and binder. The feedstock was prepared by mixing 98.8% by weight 310SC stainless steel (ferrous metal powder) with 1.2% by weight poly (propylene carbonate) (polycarbonate binder) along with 0.05% by weight or less surfactant, using a paddle mixer. The as-received ferrous metal powder had a carbon content of 0.03% by weight. The binder filled 10% of the void volume of the ferrous metal powder. The feedstock was formed into ten ferrous metal disks using a 1.8-inch compression die at ambient temperature, a residence time of one minute, and a pressure of 30,000 psi on a 5-inch diameter ram. The ferrous metal disks, which had a diameter of 1.18 inches, and a thickness of 0.075 inch, were placed in a furnace and purged with nitrogen while the temperature was increased to 400° C. at a rate of 1° C. per minute and held at 400° C. for 30 minutes. A mixed gas containing 2% hydrogen and 98% argon was then introduced into the furnace and the temperature was increased to 1010° C. at a rate of 5° C. per minute and held at 1010° C. for a period of 60 minutes. The furnace was then cooled to ambient temperature while maintaining the flow of mixed gas. All gas flows were at 10° C. per minute.

The disks produced were measured for carbon content and found to be at or below the carbon content of the metal powder used to fabricate the disks.

While there has been shown and described what are presently considered to be preferred embodiments of the invention, it will be apparent to those skilled in the art that various modifications and improvements can be made without departing from the scope of the invention as defined by the appended claims.

What is claimed is:

1. A method for preparing a low carbon content ferrous porous metal article, comprising the steps of:

mixing a low carbon content ferrous metal powder with a polycarbonate binder to form a feedstock;

feeding the feedstock to a powder metallurgy forming process;

forming the feedstock into a metal article using the powder metallurgy forming process;

heating the metal article to decompose and remove the polycarbonate binder and form a debinded metal article; and sintering the debinded metal article to form the low carbon content ferrous porous metal article, wherein the method is devoid of a step of removing residual carbon.

2. The method of claim 1, wherein the low carbon content ferrous metal powder has a carbon content less than about 0.10% by weight and the low carbon content ferrous porous metal article has a carbon content less than about 0.10% by weight.

3. The method of claim 1, wherein the low carbon content ferrous metal powder is selected from the group consisting of iron, iron-chromium alloys, iron-chromium-nickel alloys, iron-chromium-zinc alloys, iron-chromium-aluminum alloys, iron-chromium-magnesium alloys, iron-chromium-lead alloys, iron-aluminum alloys, iron-zinc alloys, stainless steels, iron-nickel alloys, and combinations thereof.

4. The method of claim 1, wherein the polycarbonate binder is selected from the group consisting of bisphenol P-type polycarbonates, bisphenol Z-type polycarbonates, copolymer-type polycarbonates of bisphenol P and bisphenol A, copolymers of a structural unit derived from benzophenone and a structural unit derived from diphenylmethan, poly (propylene carbonate), poly (ethylene carbonate), and combinations thereof.

5. The method of claim 1, wherein the step of heating the metal article to decompose and remove the polycarbonate binder is performed by raising the metal article to a temperature of about 280-360° C. at a rate of about 0.5° C. per minute to about 5° C. per minute.

6. The method of claim 1, wherein the sintering is performed by heating the ferrous porous metal article to a temperature of about 500 to about 1500° C. and maintaining that temperature for about 0.5 to about 2 hours.

7. The method of claim 1, wherein the powder metallurgy forming process is selected from the group consisting of metal injection molding, metal extrusion, compression molding, tape casting, doctoring, and isostatic pressing.

8. The method of claim 1 wherein the feedstock comprises:

about 50-98% by weight of a low carbon content ferrous metal powder; and about 2-50% by weigh of a polycarbonate binder.

9. The method of claim 8, wherein the low carbon content ferrous metal powder is selected from the group consisting of iron, iron-chromium alloys, iron-chromium-nickel alloys, iron-chromium-zinc alloys, iron-chromium-aluminum alloys, chromium-magnesium alloys, iron-chromium-lead alloys, iron-aluminum alloys, iron-zinc alloys, stainless steels, iron-nickel alloys, and combinations thereof.

10. The method of claim 8, wherein the polycarbonate binder is selected from the group consisting of bisphenol P-type polycarbonates, bisphenol Z-type polycarbonates, copolymer-type polycarbonates of bisphenol P and bisphenol A, copolymers of a structural unit derived from benzophenone and a structural unit derived from diphenylmethan, poly (propylene carbonate), poly (ethylene carbonate), and combinations thereof.

11. A method for preparing a low carbon content ferrous porous metal article, comprising the steps of:

providing a feedstock that includes at least about 90% by weight of a low carbon content ferrous metal powder and less than about 10% by weight of a polycarbonate binder;

forming the feedstock into a metal article using a powder metallurgy forming process;

heating the metal article to decompose and remove the polycarbonate binder and form a debinded metal article; and sintering the debinded metal article to form the low carbon content ferrous porous metal article.

12. The method of claim 11, wherein the sintering the low carbon content ferrous porous metal article is performed in an atmosphere free of oxygen and reactive impurities.

13. The method of claim 12, wherein the sintering is performed at a temperature of about 500-1500° C. for a time period of about 0.5-2 hours.

14. The method of claim 11, wherein the step of heating the metal article to decompose and remove the polycarbonate binder is performed in an inert atmosphere, a reducing atmosphere, or a vacuum.

15. The method of claim 14, wherein the step of heating the metal article to decompose and remove the polycarbonate binder is performed by raising the metal article to a temperature of about 280-360° C. at a rate of about 0.5° C. per minute to about 5° C. per minute.

16. The method of claim 11, wherein the method is devoid of a step of removing residual carbon, and the low carbon content ferrous porous metal article has a carbon content of less than about 0.1% by weight.

17. The method of claim 11, wherein the low carbon content ferrous metal powder is selected from the group consisting of iron, iron-chromium alloys, iron-chromium-nickel alloys, iron-chromium-zinc alloys, iron-chromium-aluminum alloys, iron-chromium-magnesium alloys, iron-chromium-lead alloys, iron-aluminum alloys, iron-zinc alloys, stainless steels, iron-nickel alloys, and combinations thereof.

18. The method of claim 11, wherein the polycarbonate binder is selected from the group consisting of bisphenol P-type polycarbonates, bisphenol Z-type polycarbonates, copolymer-type polycarbonates of bisphenol P and bisphenol A, copolymers of a structural unit derived from benzophenone and a structural unit derived from diphenylmethan, poly (propylene carbonate), poly (ethylene carbonate), and combinations thereof.

19. The method of claim 11, wherein the powder metallurgy forming process is selected from the group consisting of metal injection molding, metal extrusion, compression molding, tape casting, doctoring, and isostatic pressing.

20. A method for preparing a low carbon content ferrous porous metal article, the method comprising:

mixing a low carbon content ferrous metal powder with a polycarbonate binder to form a feedstock, the feedstock includes about 90-95% by weight of a low carbon content ferrous metal powder and about 5-10% by weight of a polycarbonate binder;

feeding the feedstock to a powder metallurgy forming process;

forming the feedstock into a metal article using the powder metallurgy forming process;

heating the metal article by raising the metal article to a temperature of about 280-360° C. at a rate of about 0.5° C. per minute to about 5° C. per minute to decompose and remove the polycarbonate binder and form a debinded metal article; and sintering the debinded metal article by heating the debinded metal article to a temperature of about 500 to about 1500° C. and maintaining that temperature for about 0.5 to about 2 hours and form the low carbon content ferrous porous article.

21. The method of claim 1 wherein the feedstock comprises:

about 90-95% by weight of a low carbon content ferrous metal powder; and about 5-10% by weight of a polycarbonate binder.

* * * * *